US005760796A

United States Patent [19]

Hayasaki et al.

[11] Patent Number: 5,760,796

[45] Date of Patent: Jun. 2, 1998

[54] LIQUID INJECTION RECORDING APPARATUS WITH A COMMON CLOCK FOR ENERGIZING RECORDING ELEMENTS AND TRANSFERRING RECORDING DATA

[75] Inventors: Kimiyuki Hayasaki, Yokohama; Hideaki Kishida, Yamato; Akira Katayama, Yokohama, all of Japan

[73] Assignee: Canon Kabushiki Kaisha, Tokyo, Japan

[21] Appl. No.: 239,849

[22] Filed: May 9, 1994

Related U.S. Application Data

[63] Continuation of Ser. No. 869,128, Apr. 15, 1992, abandoned, which is a continuation of Ser. No. 544,914, Jun. 28, 1990, abandoned.

[30] Foreign Application Priority Data

Jun. 30, 1989 [JP] Japan ..... 1-166777

[51] Int. Cl.[6] ..... B41V 2/05

[52] U.S. Cl. ..... 347/13; 347/59

[58] Field of Search ..... 347/9, 12, 13, 347/15, 57, 56, 252, 196, 182, 181, 180

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/57 |
| 4,459,600 | 7/1984 | Sato et al. | 347/65 X |
| 4,463,359 | 7/1984 | Ayata et al. | 347/57 |
| 4,558,333 | 12/1985 | Sugitani et al. | 347/65 X |
| 4,568,948 | 2/1986 | Moriguchi | 347/181 |
| 4,596,995 | 6/1986 | Yamakawa | 347/13 X |
| 4,623,899 | 11/1986 | Sakakibara | 347/182 |
| 4,639,747 | 1/1987 | Sakurada | 347/12 |
| 4,710,783 | 12/1987 | Caine | 347/182 |
| 4,723,129 | 2/1988 | Endo et al. | 347/56 |
| 4,738,553 | 4/1988 | Uemura | 347/82 |
| 4,740,796 | 4/1988 | Endo et al. | 347/56 |
| 4,899,170 | 2/1990 | Izumi | 346/76 PH |
| 4,951,152 | 8/1990 | Suzuki | 347/196 X |
| 5,017,948 | 5/1991 | Koizumi | 347/14 |
| 5,043,748 | 8/1991 | Katayama et al. | 347/16 |
| 5,221,931 | 6/1993 | Moriyama | 347/10 |

FOREIGN PATENT DOCUMENTS

| | | | |
|---|---|---|---|
| 59-123670 | 7/1984 | Japan | B41J 3/04 |
| 59-138461 | 8/1984 | Japan | B41J 3/04 |

*Primary Examiner*—Joseph W. Hartary

*Attorney, Agent, or Firm*—Fitzpatrick, Cella, Harper & Scinto

[57] ABSTRACT

A liquid injection recording head includes an integrated drive circuit a recording current energization time for electrothermal conversion elements. The setting circuit has a counter. The recording current energization time data can be set in the counter in the setting circuit in synchronism with a signal obtained by frequency-dividing a recording data transfer clock or with this clock signal supplied to a circuit arranged in the integrated drive circuit to align recording data.

21 Claims, 8 Drawing Sheets

LIQUID INJECTION RECORDING APPARATUS WITH A COMMON CLOCK FOR ENERGIZING RECORDING ELEMENTS AND TRANSFERRING RECORDING DATA

This application is a continuation of application Ser. No. 07/869,128 filed Apr. 15, 1992, now abandoned and which in turn was a continuation of application Ser. No. 07/544,914 filed Jun. 28, 1990, now abandoned.

BACKGROUND OF THE INVENTION

1. Field of the Invention

The present invention relates to a recording head for recording a dot pattern.

2. Related Background Art

A liquid injection recording method (ink-jet recording method) is a method of forming liquid droplets of a recording liquid (ink) according to various schemes and applying the droplets to a recording medium such as paper, thereby recording information. Of conventional apparatuses employing a liquid injection recording method, an ink-jet recording apparatus utilizing heat as energy for forming liquid droplets has advantages such as high resolution and high-speed production of high-quality images since a high-density multi-nozzle structure can be easily obtained.

An ink-jet recording apparatus of this type comprises a plurality of recording heads formed on a single substrate, the recording heads being provided with a plurality of liquid droplet forming means for injecting ink droplets from injection ports by heat upon application of heat energy to the ink to abruptly increase the volume of the ink, i.e., a plurality of liquid droplet forming means having electrothermal energy conversion elements (heat conversion elements hereinafter) for receiving current pulses to be heated so as to heat the ink, and an integrated circuit (drive IC) for driving the heat conversion elements.

FIG. 5 is a diagram showing an electrical arrangement of a so-called full multi-recording head, i.e., a line printer recording head as an example of an ink-jet recording head in which injection ports are aligned along the entire width of a recording medium. This head includes heat conversion elements 8 (R1, R2, . . . , Rn . . . ) and a drive IC 3 arranged in units of n heat conversion elements 8. Only the IC associated with the heat conversion elements R1 to Rn is illustrated in FIG. 5. Recording data (SI) having the same number of bits as that of the heat conversion elements 8 is sequentially transferred to a shift register 7 in each drive IC 3 in synchronism with a data transfer clock SCLK. All data are input, and the data in the shift register 7 are latched by a latch circuit 6 in response to a latch signal LAT. The plurality of drive ICs are sequentially rendered active by D flip-flops 2 in response to a divisional drive signal EI and a divisional drive signal transfer clock ECLK. For example, the recording data signal selectively energizes the ON heat conversion elements 8 during the ON period of a pulse width setting signal (not shown) input to an AND gate, thereby performing liquid injection. An output protection circuit 1 inputs a signal to cause the AND gate 4 to disable the drive signal EI when any trouble occurs during the recording operation. That is, the output protection circuit 1 prevents the heat conversion element 8 from being abnormally energized. The head unit also includes a common electrode $V_H$ for energizing the heat conversion elements 8, a common electrode P.GND for grounding the recording current. The flip-flop 2 is reset in response to a reset signal CLR.

In a conventional head, e.g., a recording head having a plurality of heat conversion elements aligned in a range corresponding to the recording width of each line, as shown in FIG. 5, it is difficult to form heat conversion elements capable of injecting liquid droplets equally from all the injection ports, judging from the quality and density of the heat conversion elements. The distribution of injection liquid droplets often undesirably varies in recording on a recording medium. Therefore, since density variations occurs in a recorded image, a good recorded image may not be obtained.

In order to solve the above problem, as a method of setting a recording current energization time (i.e., a pulse width), there is provided a method of arranging a pulse width circuit capable of arbitrarily setting an energization time by a one-shot multivibrator.

Since the recording current energization time is determined depending on the types of recording head, a pulse width circuit for setting this energization time is preferably arranged on a recording head. With this arrangement, however, a control system is complicated, and a head unit becomes bulky.

SUMMARY OF THE INVENTION

It is an object of the present invention to provide a highly reliable low-cost recording head without complicating a control system or without resulting in a bulky head unit.

It is another object of the present invention to provide a liquid injection recording head having a plurality of electrothermal conversion elements and a drive IC for selectively supplying a recording current to the electrothermal conversion elements in correspondence with recording data so as to generate injection energy, wherein the drive IC has a circuit for setting a recording current energization time of the heat conversion elements, the setting circuit includes a counter, and data within the recording current energization time is set in the counter in the setting circuit in synchronism with a signal obtained by frequency-dividing a recording data transfer clock signal or with this clock signal supplied to a circuit arranged in the drive IC to align the recording data.

It is still another object of the present invention to provide a highly reliable low-cost liquid injection recording head wherein the circuit for setting the recording current energization time (pulse width) of the liquid injection recording head is arranged in a drive integrated circuit (drive IC), a counter clock in a pulse width circuit is common to a recording data transfer clock signal or a signal obtained by frequency-dividing the recording data transfer clock signal in a shift register, thereby obtaining a good injection state free from a nonuniform density distribution.

DETAILED DESCRIPTION OF THE PREFERRED EMBODIMENTS

The present invention will be described in detail with reference to the accompanying drawings.

Figure 1:
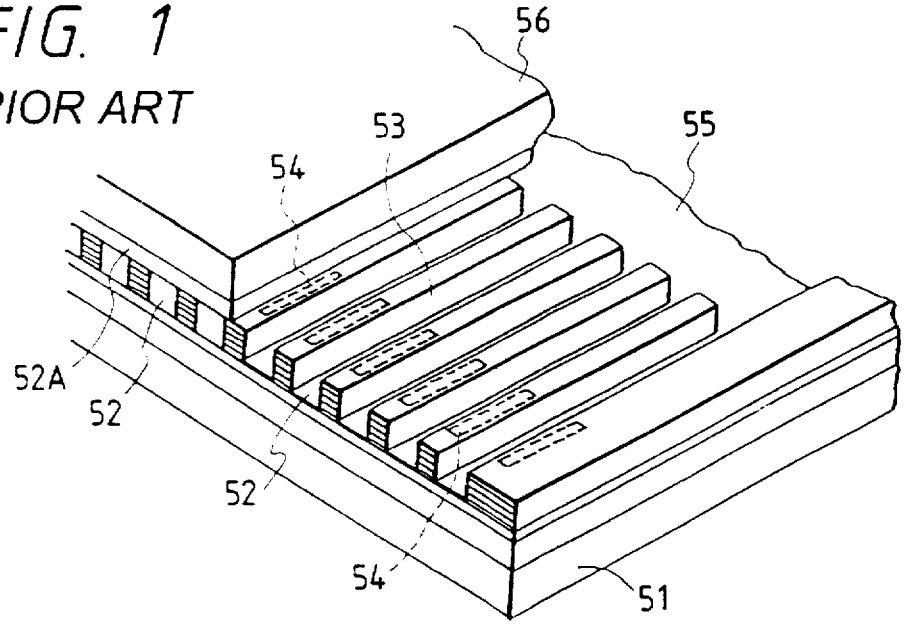
FIG. 1 PRIOR ART
FIG. 1 is a perspective view showing an arrangement of an ink-jet recording head which can employ the present invention.

FIG. 1 shows an ink-jet recording head which can employ the present invention. This recording head is of a so-called full multi-recording type in which injection ports are aligned in the range corresponding to the entire width of a recording medium.

The recording head includes heating resistors 54 constituting electrothermal conversion elements 8 energized and heated to form bubbles in the ink to perform ink injection. The heating resistors 54 are formed on a substrate 51 together with a wiring layer in the same process as in semiconductors. The recording head also includes a liquid path forming member 52A for forming injection ports 52 and liquid paths 53 communicating with the injection ports 52 in correspondence with the heating resistors 54, a top plate 56, and a liquid chamber 55 which commonly communicates with the liquid paths 53. The liquid chamber 55 stores an ink supplied from an ink source (not shown).

Figure 2:
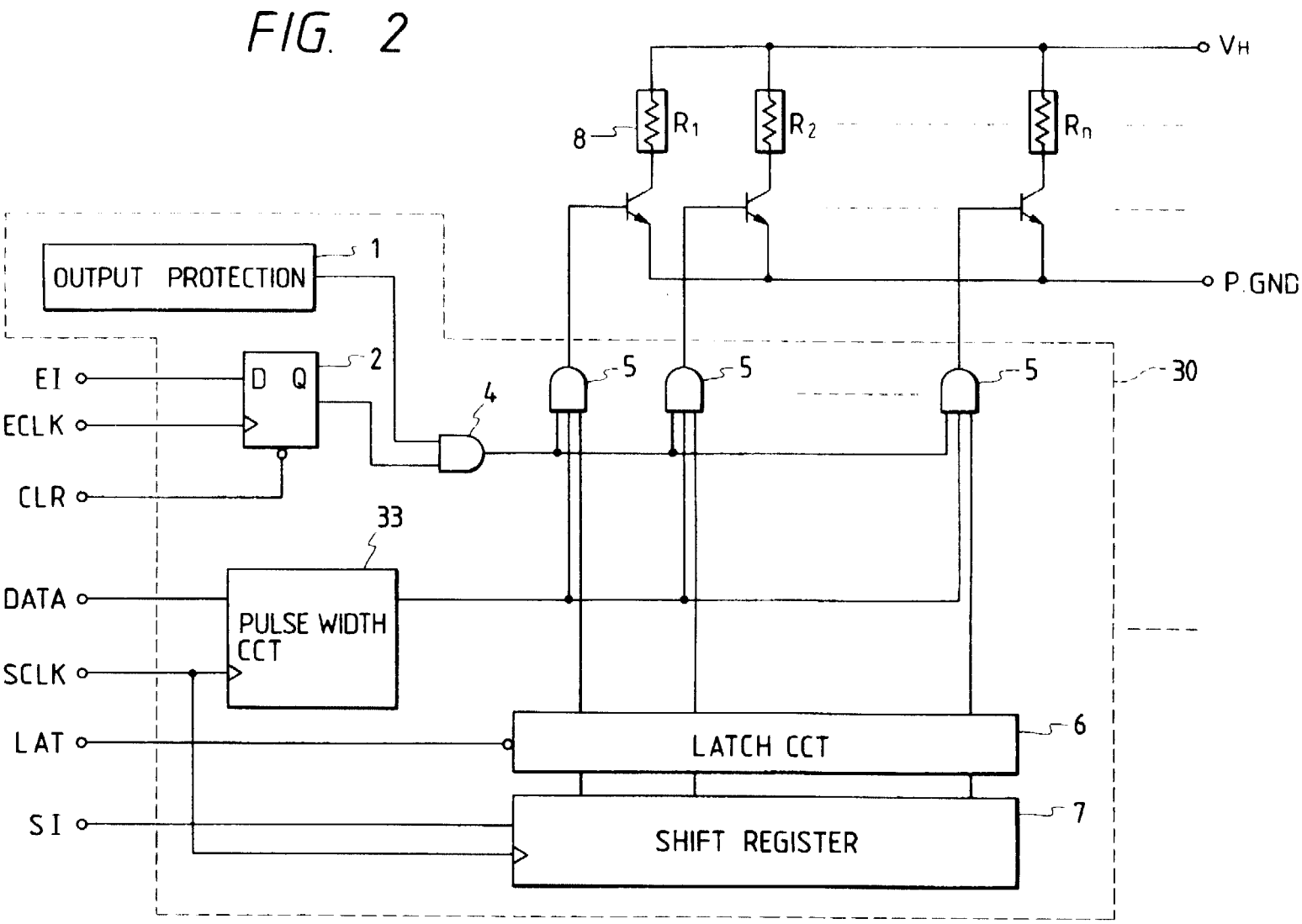
FIG. 2 is a block diagram showing a drive control system according to an embodiment of the present invention.

FIG. 2 shows an electrical circuit arrangement of the recording head having the mechanical structure shown in FIG. 1. In this structure, the drive circuit is integrally mounted with the head. FIG. 2 mainly shows one drive IC, and the same reference numerals as in FIG. 5 denote the same parts in FIG. 2.

Referring to FIG. 2, transfer data DATA is used to set a recording current energization time and can set a recording current energization time in a heat conversion element array corresponding to one drive IC. A pulse width circuit 33 which comprises a setting circuit for setting the energization time, is arranged in a drive IC 30. The pulse width circuit comprises a counter for performing a count-down (count-up operation may be performed) operation by an amount represented by the data DATA, an output terminal which is rendered active during the ON operation of the counter, and an SCLK terminal that comprises means for supplying to the IC 30 a counter clock signal used for the count-down operation that sets the energization time.

Outputs from an n-bit shift register 7, loaded with recording data in accordance with a clock signal supplied to the recording head, correspond to the heat conversion elements 8 (R1 to Rn), respectively. A recording data transfer input SI comprises means for supplying to the IC 30 recording data used for arbitrarily selecting the heat conversion elements R1 to Rn is loaded in response to an input LAT connected to an n-bit latch circuit 6 after one-line recording data is transferred. As a result, the elements R1 to Rn can be selected, as represented by the recording data SI.

Of all the circuits 1 to 7 in the drive IC 30, the clock signals associated with the components 33 and 7 are common to each other. Alternatively, a counter clock obtained by frequency-dividing the clock input to the circuit 7 is input to the circuit 33. That is, the counter clock signal used for counting down the counter in the circuit 33 is a clock signal common to the recording data transfer clock signal. An operation using the counter clock signal and recording data transfer clock signals as common clock signals will be described below.

The number of recording data transfer clock pulses is equal to the number of heat conversion elements. In this case, the clock pulses corresponding to R1 to Rm ($m \leq n$) are used as counter clock pulses in the circuit 33, and data corresponding to m-gradation recording current energization time is input to the DATA terminal. In this case, m is selected to obtain a uniform density distribution, and the energization pulse width can be selected by data having a maximum value of m to a minimum value of "1" in each drive IC 30.

An output from the pulse width circuit in each drive IC 30 determines the recording current energization time of the heat conversion element array corresponding to one drive IC 30 in accordance with an OR product between a recording signal determined by the recording data SI input to the n-bit shift register 7 and an output from the D flip-flop 2 serving as a divisional drive signal generator.

As described above, the drive IC 30 for driving a plurality of heat conversion elements mounted in the ink-jet recording head includes the energization pulse width circuit driven by a counter clock pulse common to the data transfer clock signal for selectively supplying the recording current to the heat conversion elements. The variations in fabrication of heat conversion elements can be eliminated without complicating the control system for the recording head and without increasing the size of the heat unit. The injection energy can be corrected to be an optimal value in accordance with an output from the pulse width circuit, and a nonuniform recording density distribution of a desired recording medium can be eliminated. Therefore, a highly reliable low-cost ink-jet recording head can be arranged.

Figure 3:
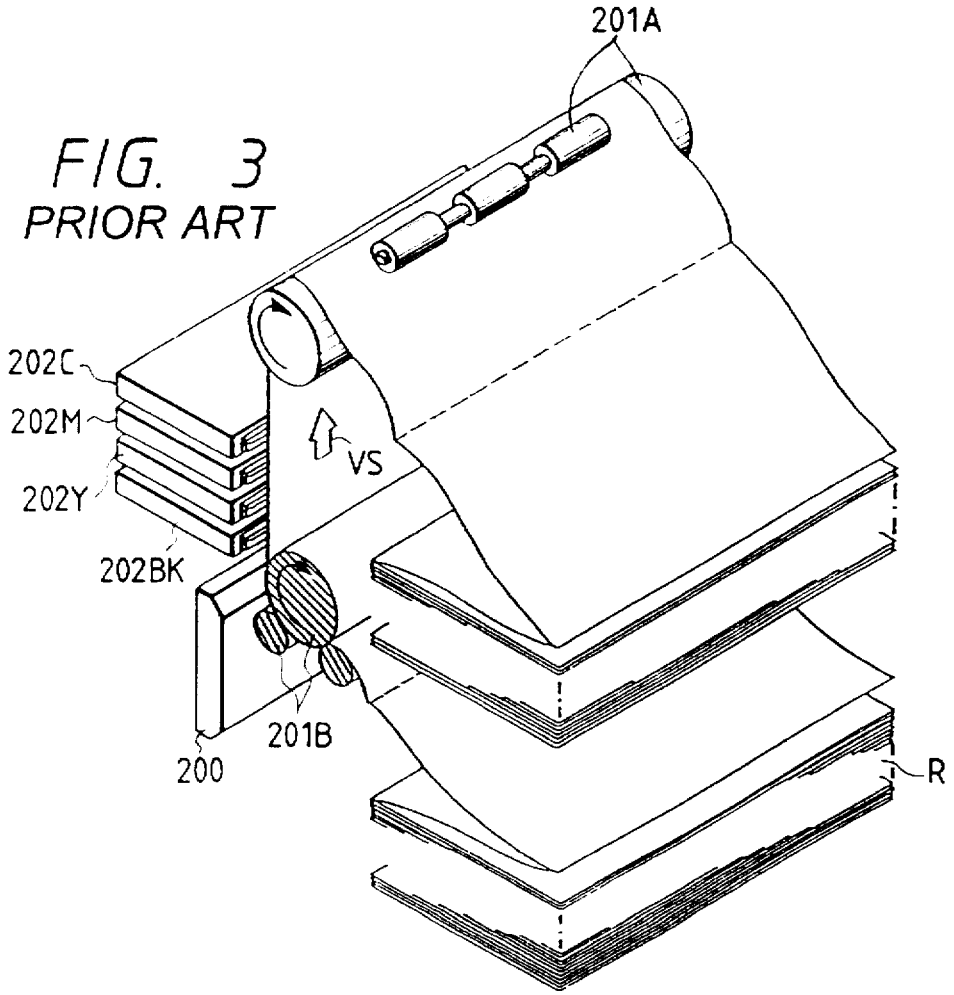
FIG. 3 PRIOR ART
FIG. 3 is a perspective view showing an ink-jet recording apparatus capable of using the recording head of this embodiment and its drive system.

A line printer capable of performing full-color recording, as shown in FIG. 3, can be arranged by using the above recording head and its drive system.

Referring to FIG. 3, the recording apparatus comprises roller pairs 201A and 201B for clamping and feeding a recording medium R in a subscanning direction Vs, and full multi-recording heads 202BK, 202Y, 202M, and 202C having nozzles along the entire width of the recording medium R to perform recording in black, yellow, magenta, and cyan. The recording heads 202BK, 202Y, 202M, and 202C are arranged from the upstream side of the feed direction in the order named.

The recording apparatus in FIG. 3 further includes a recovery system 200 which opposes the recording heads 202BK to 202C in place of the recording medium R in injection recovery processing.

Figure 4:
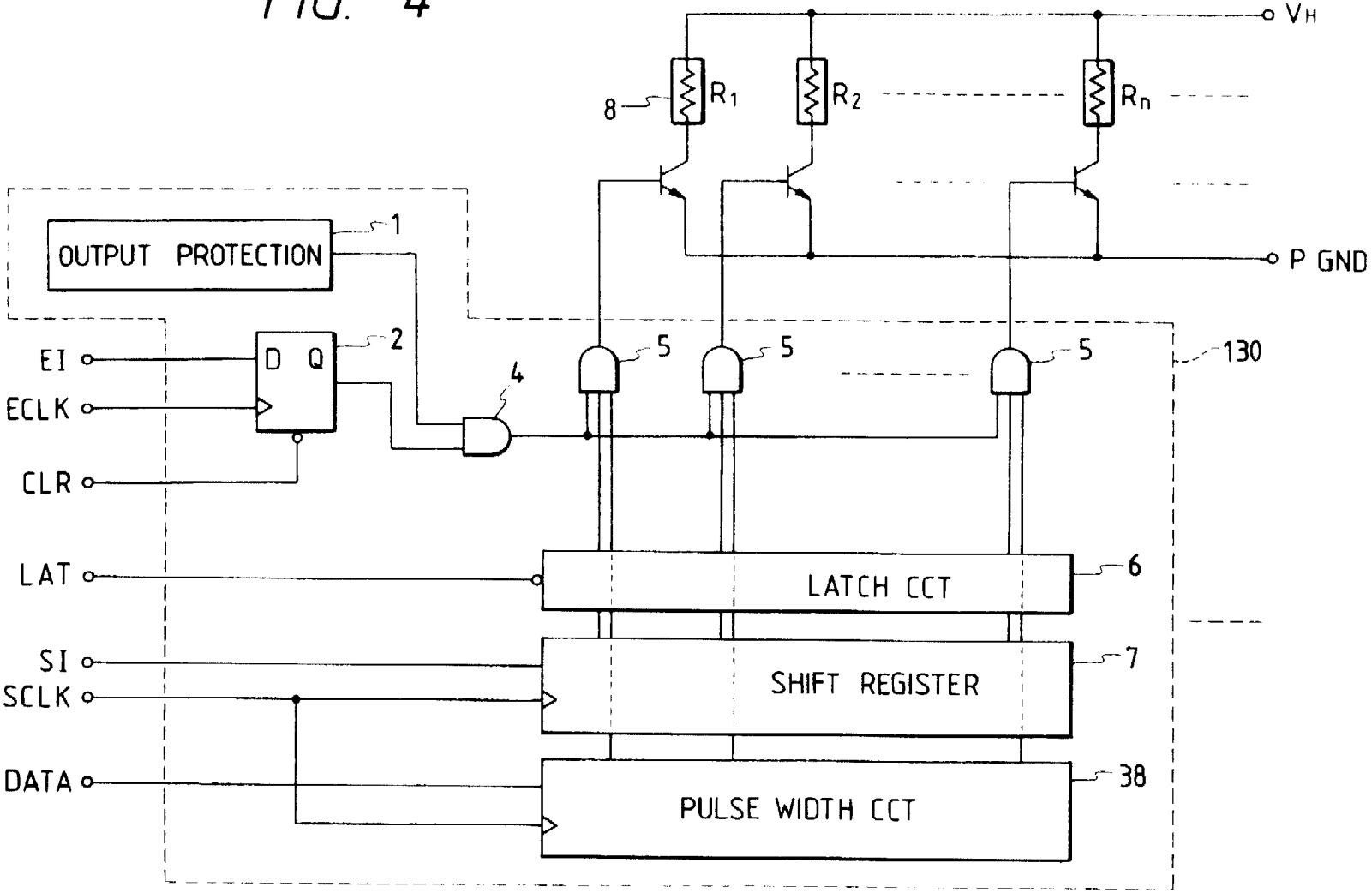
FIG. 4 is a block diagram showing a recording head drive control system according to another embodiment of the present invention.

FIG. 4 shows another embodiment of the present invention. A recording current energization time circuit 38 corresponding to each set of heat conversion elements corresponding to one drive IC is arranged in an IC 130. Although the energization pulse with is controlled in units of drive IC 30 in the arrangement of FIG. 2, the energization pulse is controlled in each of the heat conversion elements 8 corresponding to one drive IC. Although the basic operation of the arrangement in FIG. 4 is substantially the same as that in FIG. 2, the energization pulse width corresponding to each of n heat conversion elements corresponding to one drive IC can be controlled. For this purpose, the arrangement in the embodiment of FIG. 4 includes an n-bit pulse width circuit 38 having a counter.

With the above arrangement, the energization pulse width of each heat conversion element in the ink-jet recording head can be set. In this embodiment, a nonuniform recording density distribution of the recording medium does not occur, and more uniform injection states can be obtained.

This embodiment is most effective to a bubble-jet recording head and an apparatus using this head in ink-jet recording apparatuses. According to this embodiment, high-density, high-precision recording can be achieved, although a further delay may be expected in the fixing process by precise, complicated recording patterns.

Figure 7:
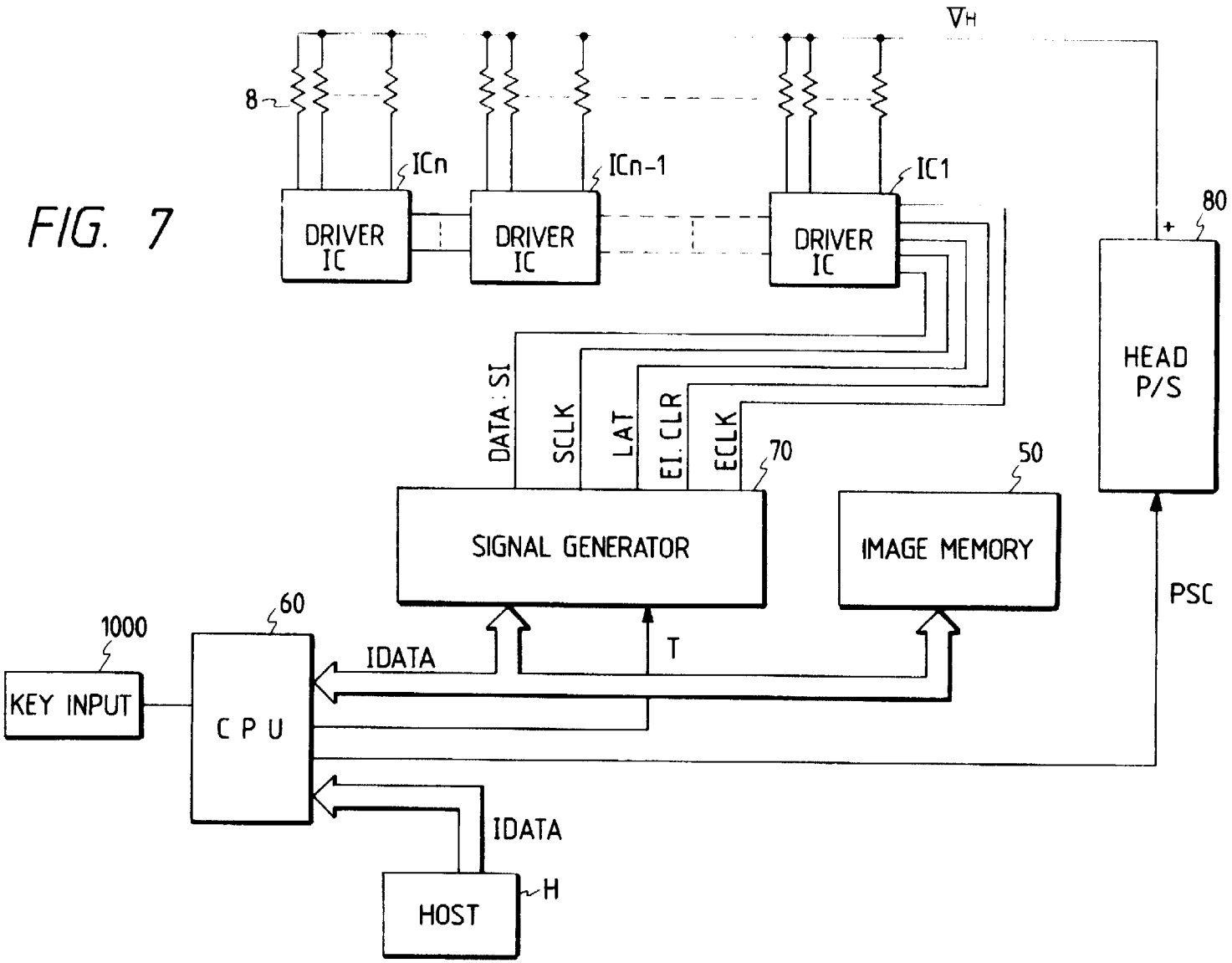
FIG. 7 is a block diagram of a circuit.

FIG. 7 is a block diagram of a printer which can employ the present invention. Upon reception of data IDATA from a host unit H, a CPU 60 transfers data (including a drive timing signal T) to an image memory 50 and a recording signal generator 70. The CPU 60 transfers a power source control signal PSC to a head power source (P/S) 80. The image memory 50 exchanges data with the CPU 60 to perform landscape/portrait conversion, masking processing, variable magnification processing, and the like. The recording signal generator 70 generates various signals shown in FIG. 2. Note that the drive IC is denoted by reference numeral 30 in FIG. 2. Energization pulse width data is loaded in the counter of the pulse width circuit in synchronism with a divisional drive signal transfer clock (ECLK) prior to energization of each block.

Figure 5:
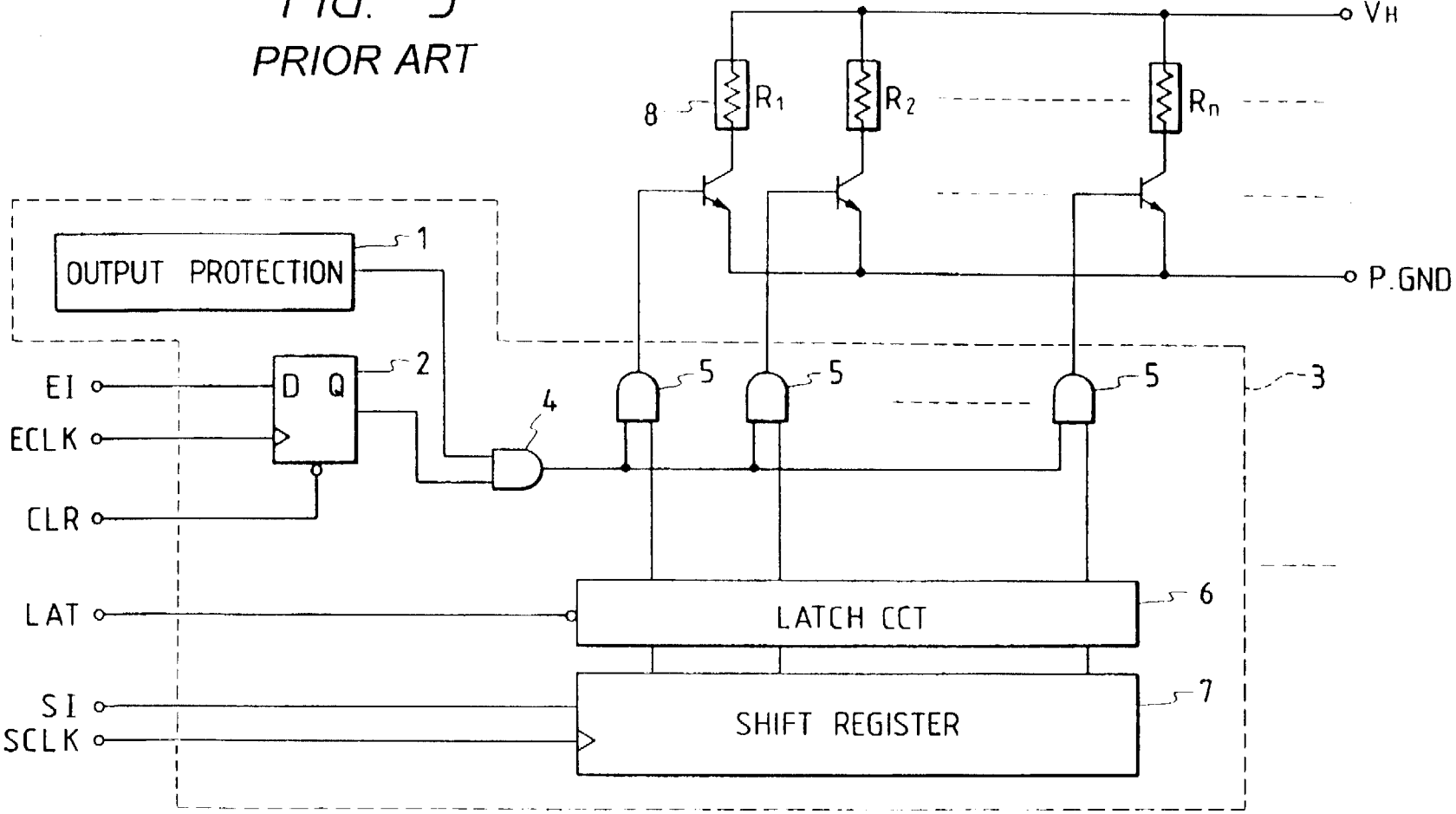
FIG. 5 PRIOR ART
FIG. 5 is a block diagram showing a conventional recording head drive control system.
Figure 6:
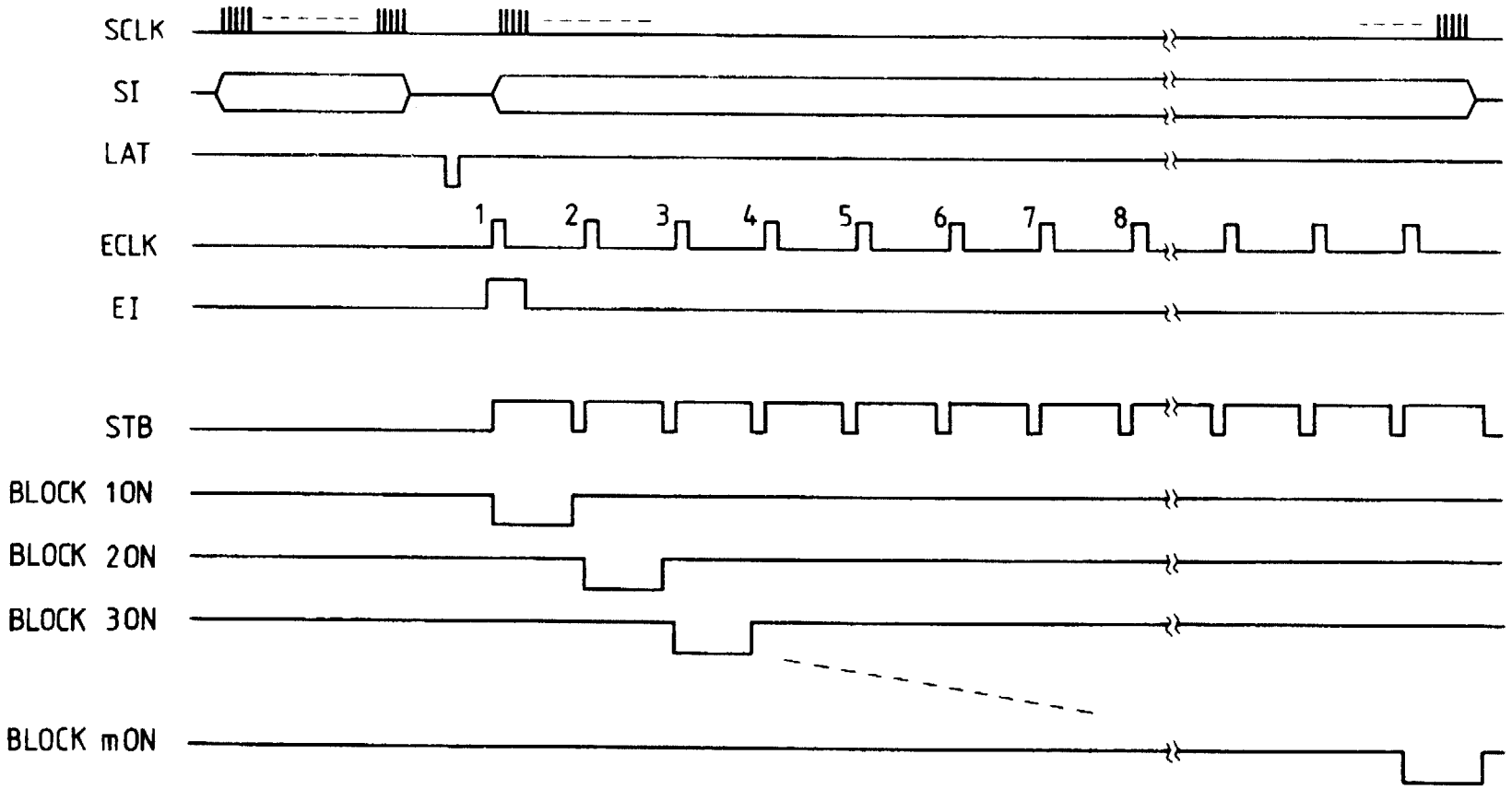
FIG. 6 is a drive timing chart showing a conventional example.
Figure 8:
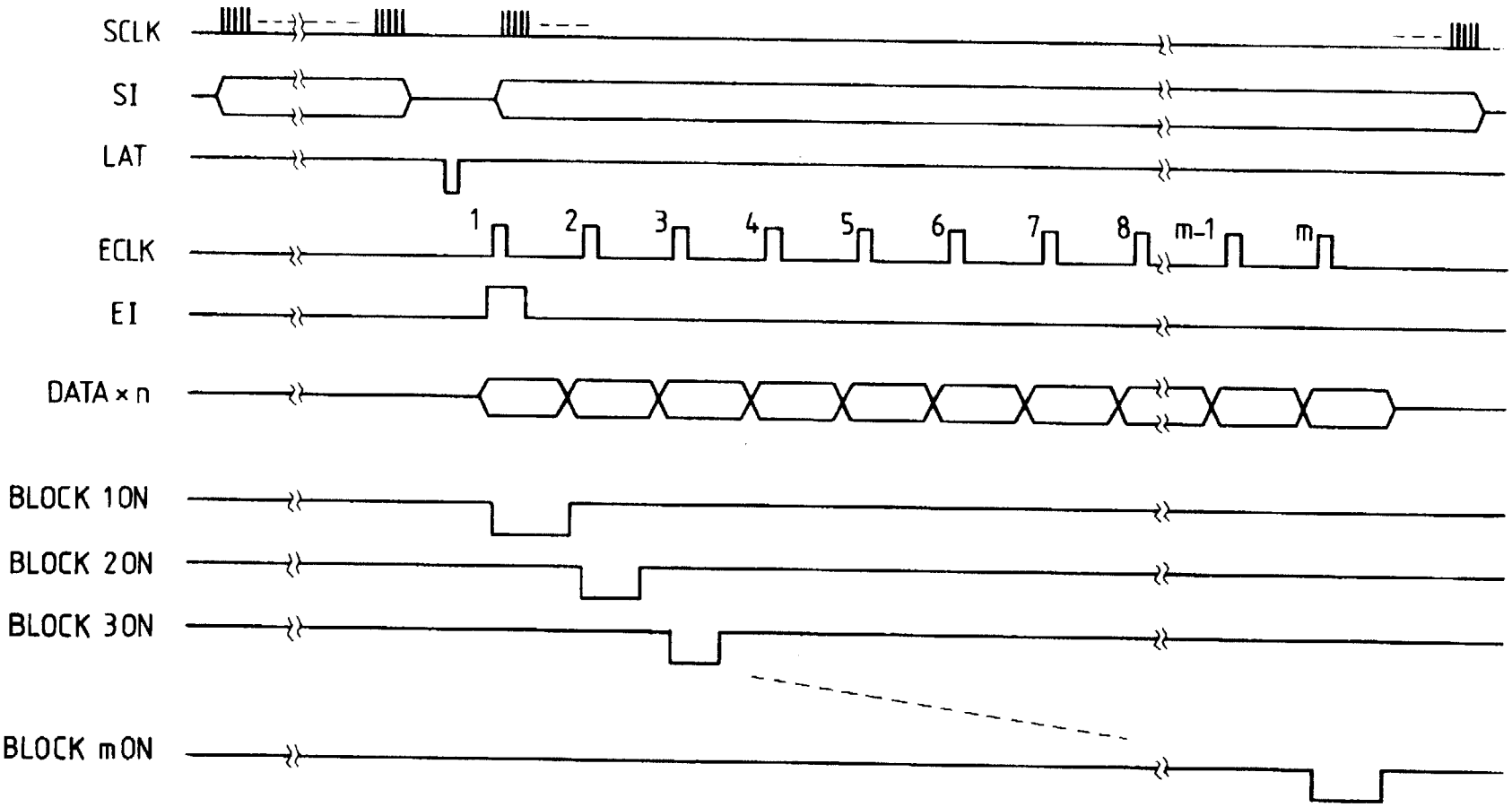
FIG. 8 is a drive timing chart of the embodiments of the present invention.
Figure 9:
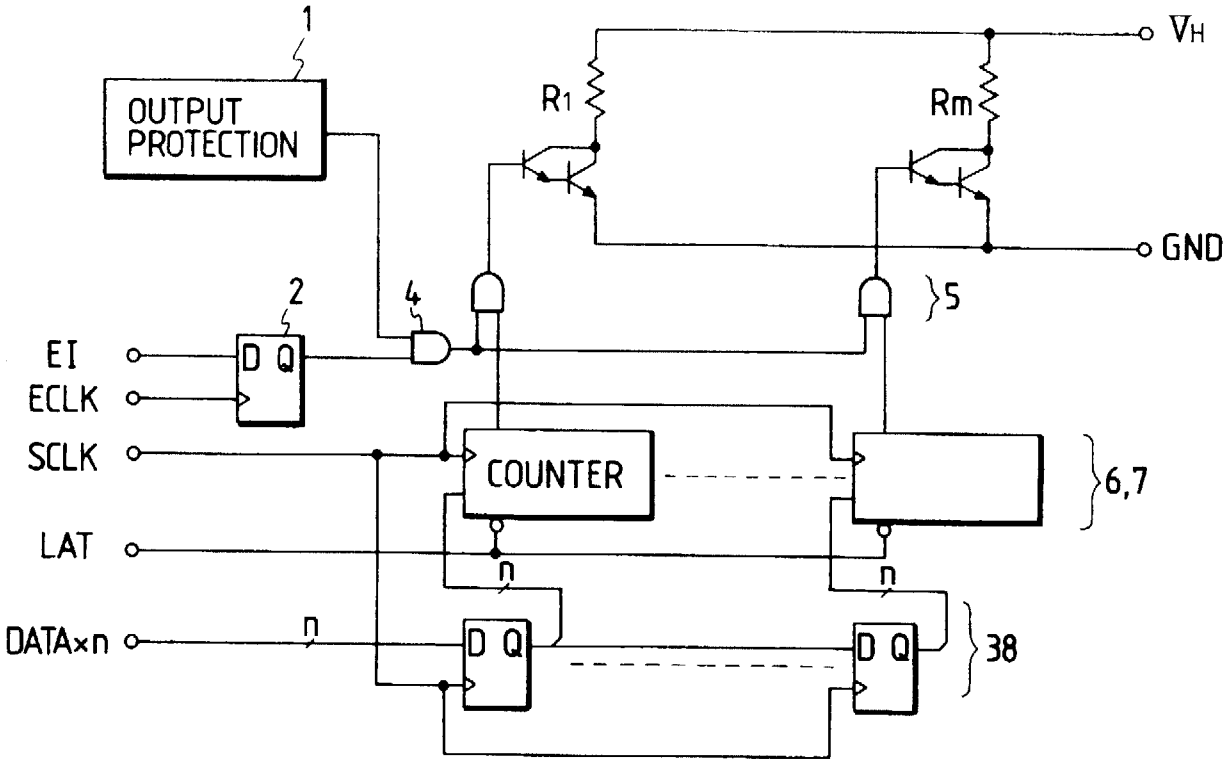
FIG. 9 is a block diagram showing a detailed arrangement according to still another embodiment of the present invention.

FIG. 6 is a drive timing chart of the conventional arrangement shown in FIG. 5. FIG. 8 is a drive timing chart of this embodiment. Unlike in FIG. 6, the clock ECLK also serves as a strobe signal for loading the pulse width data in the pulse width circuit. A detailed block diagram of the embodiment shown in FIG. 4 is shown in FIG. 9, and a detailed description thereof will be omitted.

Although not shown, a signal line for setting a value corresponding to each block in counters in the pulse width circuits 33 and 38, and a memory for storing various data and an address line therefor may be arranged in FIGS. 2 and 4 in accordance with the clock signal synchronized with the clock ECLK or a signal obtained by frequency-dividing the clock ECLK.

The arrangement in FIG. 7 includes a key input unit 1000 including a density adjustment key. Data to be set (i.e., the data to be set from the memory) may be selectively variably set in accordance with density adjustment. This variable adjustment may be performed in units of blocks or lines.

Pulse width data optimal to each head can be set by arranging the memory and the like in the corresponding recording head.

A typical arrangement and its principle are preferably based on the basic principles disclosed in U.S. Pat. Nos. 4,723,129 and 4,740,796. This scheme can be applied to either a so-called on-demand type recording head or a continuous type recording head. When the scheme is particularly applied to the on-demand type recording head, at least one drive signal for abruptly increasing a temperature exceeding a film boiling point in correspondence with recording information is applied to the sheet having a liquid (ink) thereon or the electrothermal conversion elements arranged in correspondence with the flow paths. Heat energy is generated in the electrothermal conversion elements to cause film boiling on the heat-receiving surface of the recording head, and it is effective to form bubbles of the liquid (ink) in a one-to-one correspondence with the drive signal. The liquid (ink) is injected through the injection openings upon growth and contraction of the bubbles, and at least one droplet is formed. If this drive signal is a pulse signal, the bubble can be grown and can contract properly in real time, so that liquid (ink) injection having good response can be preferably achieved. The pulsed drive signal is preferably described in U.S. Pat. Nos. 4,463,359 and 4,345,262. When conditions for a temperature rise rate on the heat-receiving surface, described in U.S. Pat. No. 4,313,124, are employed, better recording can be performed.

The recording head structure is not limited to combinations (linear and L-shaped liquid paths) of injection ports, liquid paths, and electrothermal conversion elements, as disclosed in the prior-art specifications described above. A structure in which a heat acting portion is located at a bent portion, as disclosed in U.S. Pat. Nos. 4,558,333 and 4,459,600, can be incorporated in the present invention. In addition, structures based on Japanese Patent Laid-Open No. 59-123670 using a common slit as an injection portion of an electrothermal conversion element and Japanese Patent Laid-Open No. 59-138461 in which an opening for absorbing a pressure wave of heat energy is caused to correspond to an injection portion are also incorporated in the present invention.

The number of injection ports, heat conversion elements, or drive ICs corresponding to the heat conversion elements can be arbitrarily set. As described above, the injection ports or the heat conversion elements are arranged along a full recording width of one line, and several tens of drive ICs are arranged. Alternately, as in a recording head arranged in a serial printer, several drive ICs may be used according to the scope of the present invention. In addition, the number of bits at the DATA terminal can be arbitrarily set in accordance with a degree of maximum recording density irregularity. The application purpose of the head and the resolution and the like of the heat conversion elements can also be arbitrarily determined.

The present invention is also applicable to an interchangeable chip type recording head which allows electrical connections and ink supply from a main unit, or a cartridge type recording head in which a cartridge is formed integrally with the recording head.

The number or types of recording heads can be arbitrarily determined. Only one head for one color ink may be used, or a plurality of heads corresponding to a plurality of color inks having different colors and/or densities may be used.

According to the present invention, the recording data clock signal supplied to a circuit arranged in a drive IC to align recording data or a signal obtained by frequency-dividing this clock signal is synchronized with setting of data having a predetermined recording current energization time in a counter in a setting circuit, thereby obtaining a highly reliable low-cost recording head without complicating a control system or providing a bulky head unit.

What is claimed is:

1. A liquid ejection recording head comprising a plurality of sets of (1) a group of electrothermal conversion elements and (2) an integrated drive circuit connected to said group of electrothermal conversion elements for selectively energizing said group of electrothermal conversion elements, each said integrated drive circuit comprising:

input means for inputting a divisional drive signal;

first memory means for arranging and storing a predetermined unit of recording data for supply to said group of electrothermal conversion elements;

second memory means for storing the predetermined unit of recording data transferred to said second memory means from said first memory means after the predetermined unit of recording data has been stored in said first memory means;

setting means for setting an energization time for energizing said group of electrothermal conversion elements to perform recording based on the recording data stored in said second memory means; and supply means for supplying to said setting means a clock signal for determining the energization time, the clock signal being common to a clock signal for data transfer to said first memory means, wherein said integrated drive circuit energizes said group of electrothermal conversion elements during the energization time set by said setting means in response to the clock signal supplied by said supply means and in response to the divisional drive signal input by said input means, and controls said first memory means to arrange and store a next predetermined unit of recording data in response to the clock signal supplied by said supply means.

2. A head according to claim 1, wherein said setting means is used for a predetermined number of said electrothermal conversion elements.

3. A head according to claim 1, wherein said setting means is used for units of said electrothermal conversion elements.

4. A head according to claim 1, further comprising supplying means for supplying said clock signal to said reception means, and wherein said integrated drive circuit energizes said electrothermal conversion elements during the energization time set by said setting means in accordance with a derived clock signal obtained by frequency-dividing the clock signal received by said reception means.

5. A head according to claim 1, further comprising supplying means for supplying said clock signal to said reception means, and wherein said setting means sets a plurality of energization times for energizing said electrothermal conversion elements by counting the clock signal.

6. A head according to claim 5, further comprising supplying means for supplying said clock signal to said reception means, and wherein said integrated drive circuit energizes said electrothermal conversion elements during the plurality of energization times set by said setting means in accordance with a derived clock signal obtained by frequency-dividing the clock signal received by said reception means.

7. A head according to claim 1, wherein said reception means comprises a single signal line.

8. A head according to claim 1, wherein said first memory means comprises a shift register.

9. A head according to claim 1, wherein said second memory means comprises a latch circuit.

10. A head according to claim 1, wherein said setting means comprises a counter.

11. An ink jet recording apparatus comprising:

a liquid ejection recording head comprising a plurality of sets of (1) a group of electrothermal conversion elements and (2) an integrated drive circuit connected to said group of electrothermal conversion elements for selectively energizing said group of electrothermal conversion elements, each said integrated drive circuit comprising:

input means for inputting a divisional drive signal;

first memory means for arranging and storing a predetermined unit of recording data for supply to said group of electrothermal conversion elements;

second memory means for storing the predetermined unit of recording data transferred to said second memory means from said first memory means after the predetermined unit of recording data has been stored in said first memory means;

setting means for setting an energization time for energizing said group of electrothermal conversion elements to perform recording based on the recording data stored in said second memory means; and supply means for supplying to said setting means a clock signal for determining the energization time, the clock signal being common to a clock signal for data transfer to said first memory means, wherein said integrated drive circuit energizes said group of electrothermal conversion elements during the energization time set by said setting means in response to the clock signal supplied by said supply means and in response to the divisional drive signal input by said input means, and controls said first memory means to arrange and store a next predetermined unit of recording data in response to the clock signal supplied by said supply means; and transporting means for transporting a recording medium on which said recording head records data.

12. An ink jet recording apparatus according to claim 11, wherein said setting means is used for a predetermined number of said electrothermal conversion elements.

13. An ink jet recording apparatus according to claim 11, wherein said setting means is used for units of said electrothermal conversion elements.

14. An ink jet recording apparatus according to claim 11, further comprising supplying means for supplying said clock signal to said reception means, and wherein said integrated drive circuit energizes said electrothermal conversion elements during the energization time set by said setting means in accordance with a derived clock signal obtained by frequency-dividing the clock signal received by said reception means.

15. An ink jet recording apparatus according to claim 11, further comprising supplying means for supplying said clock signal to said reception means, and wherein said setting means sets a plurality of energization times for energizing said electrothermal conversion elements by counting the clock signal.

16. An ink jet recording apparatus according to claim 15, further comprising supplying means for supplying said clock signal to said reception means, and wherein said integrated drive circuit energizes said electrothermal conversion elements during the plurality of energization times set by said setting means in accordance with a derived clock signal obtained by frequency-dividing the clock signal received by said reception means.

17. An ink jet recording apparatus according to claim 11, wherein said reception means comprises a single signal line.

18. An ink jet recording apparatus according to claim 11, wherein said first memory means comprises a shift register.

19. An ink jet recording apparatus according to claim 11, wherein said second memory means comprises a latch circuit.

20. An ink jet recording apparatus according to claim 11, wherein said setting means comprises a counter.

21. A liquid ejection recording head comprising a plurality of sets of (1) a group of electrothermal conversion elements and (2) an integrated drive circuit connected to said group of electrothermal conversion elements for selectively energizing said group of electrothermal conversion elements, each said integrated drive circuit comprising:

an input unit for inputting a divisional drive signal;

a first memory for arranging and storing a predetermined unit of recording data for supply to said group of electrothermal conversion elements;

a second memory for storing the predetermined unit of recording data transferred to said second memory from said first memory after the predetermined unit of recording data has been stored in said first memory;

a setting unit for setting an energization time for energizing said group of electrothermal conversion elements to perform recording based on the recording data stored in said second memory; and a supply unit for supplying to said setting unit a clock signal for determining the energization time, the clock signal being common to a clock signal for data transfer to said first memory, wherein said integrated drive circuit energizes said group of electrothermal conversion elements during the energization time set by said setting unit in response to the clock signal supplied by said supply unit and in response to the divisional drive signal input by said input unit, and controls said first memory to arrange and store a next predetermined unit of recording data in response to the clock signal supplied by said supply unit.

* * * * *

UNITED STATES PATENT AND TRADEMARK OFFICE

CERTIFICATE OF CORRECTION

PATENT NO. : 5,760,796

DATED : June 2, 1998

INVENTOR(S) : KIMIYUKI HAYASAKI, ET AL.

It is certified that error appears in the above-identified patent and that said Letters Patent is hereby corrected as shown below:

AT [57] ABSTRACT

"circuit" should read --circuit having a circuit for setting--.

COLUMN 2

Line 7, "occurs" should read --occur--.

COLUMN 4

Line 44, "with" should be deleted.

Signed and Sealed this

Nineteenth Day of January, 1999

*Attest:*

*Attesting Officer*

*Acting Commissioner of Patents and Trademarks*